US008479366B2

(12) United States Patent
Cronier et al.

(10) Patent No.: US 8,479,366 B2
(45) Date of Patent: Jul. 9, 2013

(54) METHOD FOR CHANGING A ROLLER IN A ROLL MILL FOR A CONTINUOUSLY RUNNING STEEL STRIP

(75) Inventors: Vincent Cronier, La Ricamarie (FR); Bernard Rossigneux, Lezigneux (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 237 days.

(21) Appl. No.: 13/000,062

(22) PCT Filed: Jun. 19, 2008

(86) PCT No.: PCT/FR2008/000857

§ 371 (c)(1),
(2), (4) Date: Dec. 20, 2010

(87) PCT Pub. No.: WO2009/153415

PCT Pub. Date: Dec. 23, 2009

(65) Prior Publication Data

US 2011/0099783 A1 May 5, 2011

(51) Int. Cl.
*B23P 6/00* (2006.01)

(52) U.S. Cl.
USPC ..... 29/402.08

(58) Field of Classification Search
USPC ..... 29/402.08, 402.01, 407.01, 407.05, 29/895.1; 162/199; 72/238, 239; 414/589
See application file for complete search history.

(56) References Cited

U.S. PATENT DOCUMENTS 7,381,301 B2 6/2008 Wittkopf

FOREIGN PATENT DOCUMENTS

| | | | |
|---|---|---|---|
| DE | 41 04 001 | A1 | 8/1992 |
| JP | 62-101307 | A | 5/1987 |
| JP | 62-101309 | A | 5/1987 |
| JP | 62-275515 | A | 11/1987 |
| RU | 2006304 | C1 | 1/1994 |
| RU | 2004106602 | A | 6/2005 |
| WO | 03015948 | A1 | 2/2003 |

*Primary Examiner* — John C Hong
(74) *Attorney, Agent, or Firm* — Laurence A. Greenberg; Werner H. Stemer; Ralph E. Locher

(57) ABSTRACT

A method for changing rollers in a roll stand adapted for bearing at least one working roller for a continuously-running steel-strip roll mill, includes providing the stand as part of a plurality of roll stands disposed in series along the roll mill in a continuous running direction. A rolling standby function in a free clamping position of the roller(s) is allocated to at least one dedicated stand among the plurality of stands. Original setpoint values controlling an adjustment of the roller clamping are individually allocated to the other stands in an active rolling position. In the case of a roller change when passing into the free clamping position of the stand, the original setpoint value of the stand and the original setpoint values of the stands remaining in an active rolling position are redistributed individually among each of the stands, including the dedicated stand.

5 Claims, 2 Drawing Sheets

METHOD FOR CHANGING A ROLLER IN A ROLL MILL FOR A CONTINUOUSLY RUNNING STEEL STRIP

Method for changing a roller in a roll mill for a continuously running steel strip

BACKGROUND OF THE INVENTION

Field of the Invention

The present invention concerns a method for changing a roller in a roll stand adapted for bearing at least one working roller for a continuously running steel-strip roll mill, the stand forming part of a plurality of roll stands disposed in series along the roll mill in the continuous running direction.

In particular, the invention relates to the technical field of cold-rolling of steel strips on a tandem type continuous roll mill, requiring changes of rolling rollers.

Cold-rolling of steel strips can be carried out on different types of rolling installations:

- Rolling installations known as "reversible" in which the strip to be rolled moves alternately in one direction of travel and then the other between at least two units able to either unwind or re-wind the strip during different rolling runs. Between these unwinding/winding units, the strip is rolled in a single roll stand, which gives the installation a capacity of 200 000 to 600 000 t/year, or in two successive stands, which brings the production capacity to 300 000/1 000 000 t/year.
- Rolling installations known as "tandem", in which the strip to be rolled moves in a single direction of travel in a plurality of roll stands arranged in series one behind the other located between an unwinding unit upstream and a rewinding unit downstream in the direction of travel. Said roll stands comprise, as is known, uprights bearing rolling rollers know as "working rollers", supporting rollers restricting the flexion of the working rollers and, in certain cases, one or two pairs of intermediate rollers between the supporting rollers and the working rollers. Special applications intended for rolling the hardest steels also involve assemblies of multiple rollers, such as, for example, roll mills known as "Sendzimir". There are several types of cold-roll mills of the tandem type: conventional roll mills operating reel by reel and capable of producing of 700 000 to 1 500 000 tonnes of rolled steel per year; their investment cost is high and they have the disadvantage of requiring the engagement of the head of each reel across the entire installation. Other tandem roll mills are organized to operate in continuous mode, the tail of a reel emerging from the unwinding unit being welded to the head of a new reel unwound by a second unwinding unit. Such continuous roll mills achieve production rates of 1 000 000 to 3 000 000 t/year.

In view of the investment allocated to ensure continuity of rolling operations, it is necessary to eliminate as much as possible the dead time during which the roll mill is not rolling, just as it is necessary to reduce the loss of linear yield as far as possible, i.e. the quantity of rolled strip outside the required tolerances.

For various reasons, such as maintenance, it is regularly necessary to change rollers in roll stands, in particular working and intermediate rollers or cassettes of multiple rollers and rolling has to be interrupted throughout this operation.

In fact, during rolling, the rollers are subjected to high pressures, which produce gradual cold hardening of their surface, which, when it becomes too great, embrittles the roller, which may then exhibit cracks or flaking.

Also, the permanent contact of the working rollers with the rolled strip and with the supporting or intermediate rollers gives rise to degradation of their surface condition, requiring them to be changed when the surface condition, particularly on the last roll stand downstream of the roll mill (outlet from the roll mill), no longer allows the required surface quality of the rolled strip to be achieved.

Finally, depending on the rolling program, it is usual to be able to change the diameter of the working rollers or the configuration of at least one roll stand, for example from a "quarto" mode to a "sexton" or multi-roller mode. It is then necessary to undertake a physical change of the rollers concerned.

In order to simplify and shorten the roller change operations as far as possible, automated equipment and procedures have long been in place, such as those described in WO 2007 060370. The change times vary, depending on the installations, from 2 to 3 minutes.

The fall in productivity due to roller changes is particularly great for stands in roll mills equipped with very small rollers, on which the cold hardening and surface wear are very rapid, for example multi-roller stands used for rolling stainless steels.

If the case of a tandem roll mill with four stands intended to roll 50 000 reels (about 1 000 000 tonnes) per year of stainless steels is considered, it is necessary to stop the roll mill in order to change the rollers on the last stand about every 1 to 3 reels. Since a very quick roller change lasts at least 2 minutes, the result is that, even if the rollers on the other stands are changed (less frequently) "in the background" during changes of those on the last stand downstream, the annual change time may reach 1700 hours/year or a stoppage rate of 24% for activities over 300 days/year, 24 hours a day. At best, this rate may fall to 8% with changes every three reels, which is still very high.

Furthermore, when re-starting the roll mill (stoppage of strip movement), optimum rolling conditions are not achieved immediately and the strip is rolled outside acceptable tolerances over about 50 to 75 meters of strip, which impacts on the linear yield.

Attempts have been made to effect roller changes without interrupting rolling. A method suitable for a tandem roll mill with 6 stands is, for example, described in JP 62-275515. This method for changing rollers on a roll stand is adapted for bearing at least one working roller for a continuously running steel-strip roll mill, said stand forming part of a plurality of roll stands positioned in series along the roll mill in a direction of continuous travel. When a roller change is planned on any stand (according to an example described in FIG. 2 of said document), its stoppage is prepared by distributing its reduction rate (percentage reduction in thickness of the rolled product) to the stands upstream and downstream according to the following time sequence:

- Increase in reduction of the stands (upstream of the stand concerned by the change) by a fraction of that required to compensate for the opening of the stand concerned by the change, following a sequence of first stand in the tandem roll mill, then second stand, etc.
- Diminution in reduction of the stand concerned by the change while retaining only a low residual value.
- Increase in reduction of the stands (downstream of the stand concerned by the change) as already done for the upstream ones, first of all on the closest stand to the stand concerned, then on the next, etc.

Complete opening of the stand concerned simultaneously with the increase in reduction of the stand located immediately upstream.

Change of roller(s) in the stand concerned.

Closure of the stand concerned at low reduction simultaneously with diminution in reduction of the stand located immediately upstream of said stand concerned.

Return to original levels of reduction of the stands upstream, beginning with the first stand in the tandem roll mill, then the second.

Closure of the stand concerned at its original reduction level.

Return to original levels of reduction of the stands downstream of the stand concerned, beginning with the closest.

This procedure requires, as can be seen, distribution of the clamping forces of the rollers remaining in active rolling position and the speed and torque of the motors in a stand to the others, i.e. between 15 and 20% overload for some stands in this tandem roll mill with six stands. But the clamping force of the roll stands can only be increased within the limit of Hertz pressure resistance of the rollers, which falls with the diameter of the rollers. When this limit has been reached, if it is necessary to retain a capacity margin of 20% with a view to roller changes, the roll mill assembly cannot operate at its maximum capacity and is constantly at a disadvantage in terms of production capacity. The gain in productivity with a roller change "on the fly" then becomes marginal or non-existent.

Furthermore, the time sequence of increase and then diminution in clamping of the stands upstream and downstream as described in JP 62-275515 is not in a position to produce good continuity of strip thickness throughout the process, hence an incorrect final rolling thickness in some phases and a degradation of linear yield.

Finally, the rolling plan, i.e. for a given product and a particular final thickness (involving the reduction rate in each stand, the rotational speed of the rollers in each stand, the traction between each stand), must be modified for six stands twelve times throughout the change procedure in order to distribute a share of the reduction in thickness not produced in the stand undergoing change to each of the stands upstream and downstream of the site of the change.

This transition from normal rolling with six stands to rolling with the remaining five stands and then the return to rolling with six stands is difficult to manage and may even become critical if the increases in reduction give rise to a change in the metallurgical behavior of the steel, for example its cold hardening.

When this transition is concomitant with a change in the format of the rolled strip (format is taken to mean its width, its input thickness, its metallurgy), the management of the transitions may be found to be almost impossible. JP 62-275515 indicates that it is advantageous to position the roller(s) change during passage of a strip weld in order to "group" the lengths outside the tolerances specific to the roller change procedure and the inevitable cut to be made to eliminate the weld. Thus systematizing the passage of strip welds with the change of rollers inevitably results in their concomitance with all the changes in strip format and aggravates the risks of not being able correctly to control the change operation, whatever the strip.

BRIEF SUMMARY OF THE INVENTION

An object of the present invention is to propose a method for changing roller(s) on a roll stand adapted for bearing at least one working roller for a continuously running steel-strip roll mill, said method making it possible to resolve the above mentioned problems.

One solution is proposed by a method according to the invention as follows:

On the basis of a method of changing roller(s) in a roll stand adapted for bearing at least one working roller (with a strip clamping function) for a continuously running steel-strip cold roll mill (tandem type), said stand forming part of a plurality of roll stands arranged in series along the roll mill in a direction of continuous running, it is proposed that:

a rolling standby function in a free clamping position of the roller(s) (i.e. free from pressure on the strip) is allocated to at least one dedicated stand among the plurality of stands, original setpoint values controlling an adjustment associated with the clamping of the roller(s) are individually allocated to the other stands in an active rolling position, in the event of a roller change when putting the stand into the free clamping position, the original setpoint value of said stand and the original setpoint values of the stands remaining in an active rolling position are redistributed individually among each of said stands, including the dedicated stand.

In other words, the roll mill comprises a number of stands, one of which is permanently put into free clamping function (said dedicated stand). Unlike a roll mill for which one stand of its plurality of stands is taken out of operation, the dedicated stand according to the invention is substituted for the stand for which at least one roller has to be changed. Thus, very advantageously, a new complex distribution of reduction rates over the remaining stands can be avoided, since it is possible simply to transfer or redistribute the clamping setpoint values of one stand to another stand, the two stands being put into active continuously running strip rolling position. Similarly, this setpoint value transfer procedure remains in a very binary form of adjustment and therefore circumvents the conditions of specificity and strip format, and also any concomitance with strip welds or cuts.

The time sequence of increase and then diminution of stand clamping according to the transferred/redistributed setpoint values may therefore be greatly simplified and reduced, which makes the strip thickness at the outlet from the roll mill more controllable at the required tolerances and also guarantees excellent linear yield.

Of course, owing to a synchronized transfer of setpoint values between the stands concerned, the invention makes it possible to change rollers without any interruption in strip movement. During the roller change phase, the productivity of the roll mill remains at its maximum, just like in roller non-change phase.

BRIEF DESCRIPTION OF THE SEVERAL VIEWS OF THE DRAWING

Examples of embodiments and applications are provided using the figures described.

DESCRIPTION OF THE INVENTION

All the figures described below present a roll mill comprising six stands and their rollers C1, C2, C3, C4, C5, C6 arranged in series along the continuously running strip B in its direction D of travel. For the sake of clarity, an upper section of the strip interrupted by a plane of symmetry Ax (parallel and equidistant to the two strip surfaces) is also represented. Each of five of the six rollers in active rolling position is allocated a clamping setpoint value R1, R2, R3, R4, R5. By extension, reference is made to the term "stand" to designate at least one roller in the same stand. Similarly, the terms "first stand", "second stand", "N-th stand" are used. This numbering means that the first stand is located furthest upstream in the direction D of strip travel (at the entry of the strip into the roll mill), while the subsequent stands are positioned further and further downstream of the first stand.

More generally, the roll mill represented provides for the implementation of the method of changing rollers in a roll stand C adapted for bearing at least one working roller for said continuously running steel-strip roll mill, said stand C forming part of a plurality N (present case N=6) of roll stands arranged in series along the roll mill in the continuous running direction D, so that:

- a rolling standby function in a free clamping position of the roller(s) is allocated to at least one dedicated stand CA among the plurality N of stands,
- original setpoint values controlling an adjustment associated with the clamping of the roller(s) are individually allocated to the other stands in an active rolling position,
- in the event of a roller change when putting the stand C into free clamping position, the original setpoint value of said stand C and the original setpoint values of the stands remaining in an active rolling position are redistributed individually among each of said stands, including the dedicated stand CA.

The strip B is constantly rolled by passing into N-1 roll stands of a total number of N stands making up the roll mill, any one of the stands in the roll mill being either undergoing a change of rollers (and thus designated stand C) or in standby position awaiting a new change operation (and thus designated stand CA or C).

The stand C in which a roller(s) is to be changed thus remains in standby position just like the status of the original dedicated stand CA until the next change of roller(s) in another stand.

Depending on the relative position of the dedicated stand CA on standby with respect to the stand C where rollers are to be changed, the method in a first embodiment has two variants, respectively represented by FIGS. 1*a*, 1*b* and 2*a*, 2*b*.

Figure 1A:
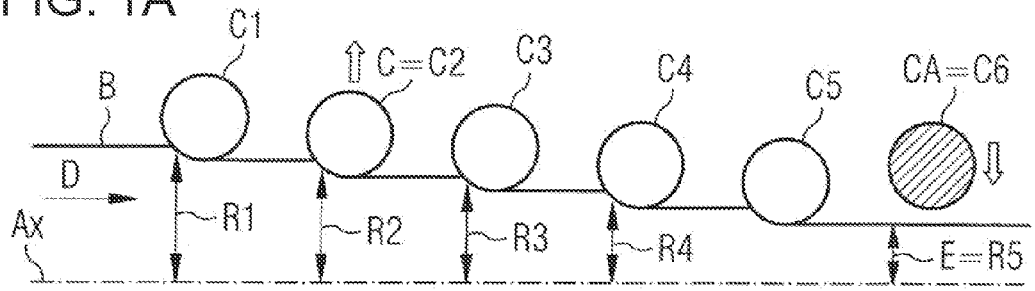
FIGS. 1*a*, 1*b* method of change according to a first embodiment of the invention, FIGS. 2*a*, 2*b* method of change according to a variant of the first embodiment of the invention, FIGS. 3*a*, 3*b*, 3*c* method of change according to a second embodiment of the invention.

FIG. 1*a* shows a roll mill status preceding a roller change for the second stand C=C2. In the direction D of travel of the strip, the dedicated stand CA=C6 is then the sixth stand C6 and is therefore located downstream of the second stand C=C2 destined for an imminent change. The dedicated stand CA=C6 is in rolling standby function in a free clamping position. At this stage, the first five stands C1, C=C2, C3, C4, C5 are in active rolling position according to each of the original clamping setpoint values R1, R2, R3, R4, R5 which are allocated to them and induce increasing rolling of the strip. The last setpoint value R5 on the fifth roller C5 enables the strip to have a thickness E at the outlet from the roll mill.

Figure 1B:
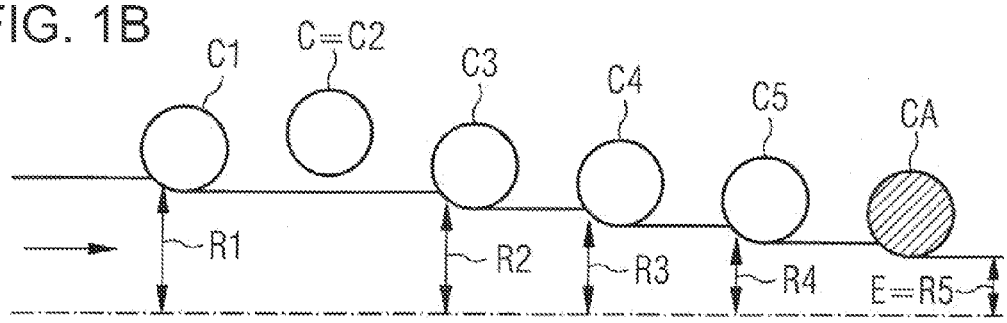

FIG. 1*b* shows a roll mill status in roller change phase (second stand C=C2) as represented in FIG. 1*a*. During the roller change on the second stand C=C2 located in the direction D of travel upstream of the initially dedicated stand CA=C6 in standby position, the original setpoint value R2 of said second stand C=C2 is transferred to the third stand C3 located immediately downstream of it, the original setpoint value R3 of this third stand C3 being itself transferred to the fourth stand C4 located immediately downstream of it and, if necessary (as here), the original setpoint value R4 of this fourth stand C4 is itself transferred to the fifth stand C5 located immediately downstream of it, and so on as far as the dedicated stand CA=C6 in standby position, which is then put into active rolling position at the last and fifth setpoint value R5.

The roller(s) change on the second stand C=C2 can then be carried out without interrupting the movement of the strip. It is then also possible to allocate to this second stand the standby function of the dedicated stand CA=C6 (now in active rolling function), until a change of another roller/stand C is to take place. The method can therefore be applied without time limit, if desired, by simple reallocation of the standby function (free from rolling) of the dedicated stand to one of the stands in which a roller change has taken place, thus awaiting the next change of stand.

Figure 2A:
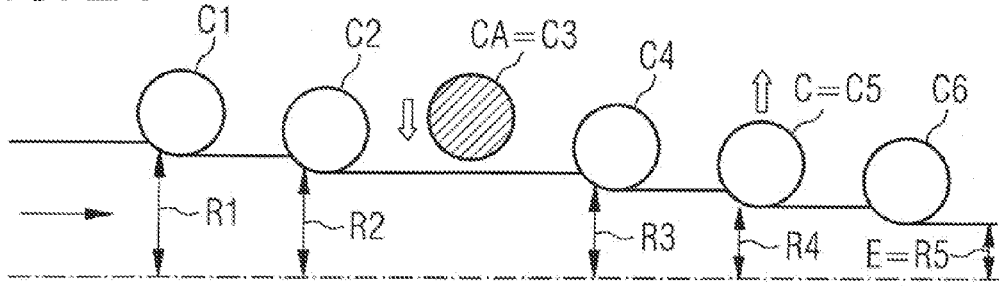

FIG. 2*a* shows a roll mill status according to a variant of the roller change in FIGS. 1*a*, 1*b* taking place for the fifth stand C=C5. In the direction D of travel of the strip, the dedicated stand CA=C3 is (inversely to FIGS. 1*a*, 1*b*) the third stand C3 and is therefore located upstream of the fifth stand C=C5 destined for an imminent change. The dedicated stand CA=C3 is in rolling standby function in free clamping position. At this stage, the first two and the last three stands C1, C=C2, C4, C5, C6 are in active rolling position according to each of the original clamping setpoint values R1, R2, R3, R4, R5 which are allocated to them and induce increasing rolling of the strip. The last setpoint value R5 on the sixth roller C6 enables the strip to have a thickness E at the outlet from the roll mill.

Figure 2B:
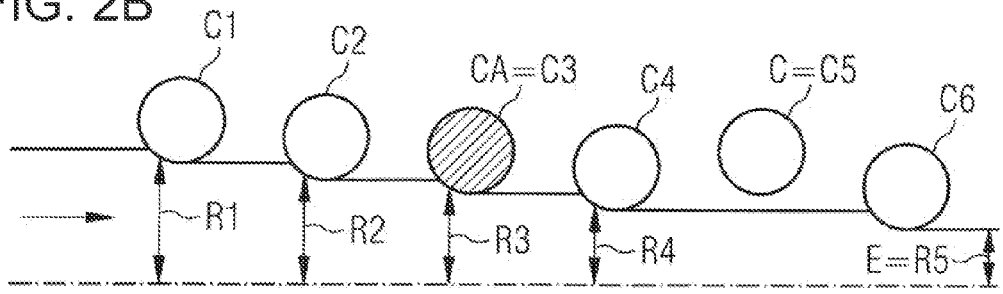

FIG. 2*b* shows a roll mill status in roller change phase (fifth stand C=C5) as represented in FIG. 2*a*. During the roller change on the fifth stand C=C5 located in the direction D of travel downstream of the (third) initially dedicated stand CA=C3 in standby position, the original setpoint value R4 of said fifth stand C=C5 is transferred to the fourth stand C4 located immediately upstream of it, the original setpoint value R3 of this fourth stand C4 being itself transferred to the third stand C3 (here also the dedicated stand CA) located immediately upstream of it. The first and second stands C1, C2 maintain their clamping position at their respective setpoint values R1, R2. If there were more stands inserted between the stand C destined for change and the dedicated stand CA upstream of it, the original setpoint values of said inserted stands would themselves have been transferred to the stands located immediately downstream of them, and so on as far as the dedicated stand CA in standby position, which is then put into active rolling position at the third setpoint value R3 (original setpoint value of the fourth stand prior to roller change).

The roller(s) change on the fifth stand C=C5 can then be carried out without interrupting the movement of the strip. Identically to the first embodiment according to FIGS. 1*a*, 1*b*, it is then also possible to allocate to this fifth stand the standby function of the dedicated stand CA=C3 (now in active rolling function), until a change of another roller/stand C is to take place. The method can therefore be applied without time limit, if desired, by simple reallocation of the standby function (free from rolling) of the dedicated stand to one of the stands in which a roller change has taken place, thus awaiting the next change of stand.

In both cases according to FIGS. 1*a*, 1*b* and 2*a*, 2*b*, there is just a single stand-to-stand transfer of adjustment setpoints belonging to the original rolling plan and not a specific and complex change to the rolling plan.

Also, transfers of adjustment setpoints by means of an automatic strip thickness control system (known as Automatic Gauge Control "AGC") are organized to take account of inter-stand strip travel times so that no portion of said strip is outside the thickness tolerance. The change operation therefore has no impact on the linear yield.

Finally, by not having to be overloaded momentarily by the distribution of reduction from a stand destined for roller(s) change to the other stands, all the stands can operate at their maximum capacity, which is the best way of making a return on investment as great as a tandem continuously running steel-strip roll mill.

Figure 3A:
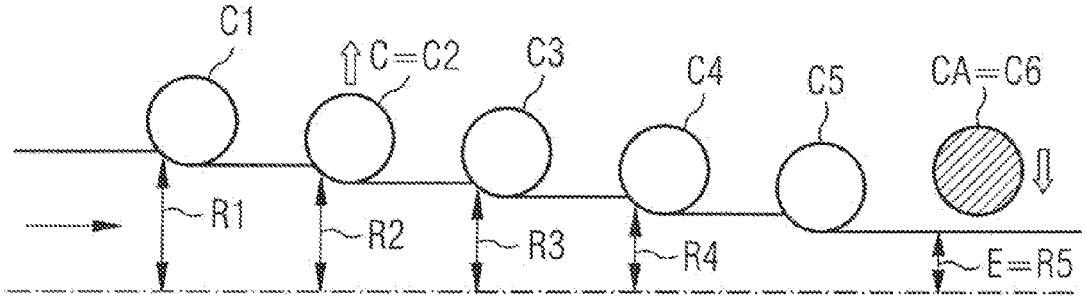
Figure 3B:
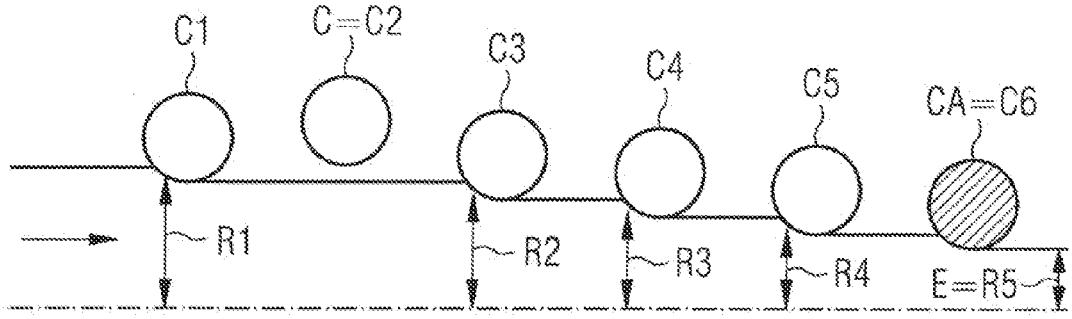
Figure 3C:
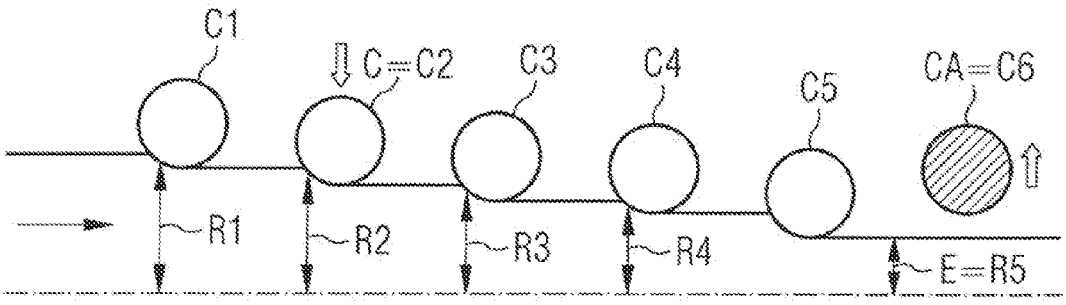

FIGS. 3*a*, 3*b* and 3*c* describe a second embodiment of the invention. In principle, FIGS. 3*a* and 3*b* are identical to FIGS. 1*a* and 1*b*, in that the dedicated stand CA=C6 in standby position is located in the direction D of travel downstream of the last stand C5 in active rolling position. The stand CA is dedicated to allow for a roller change on all the other stands located upstream of it. It is not put into operation until any stand on the roll mill is undergoing a roller change and only for the duration of the change. Except during roller change operations, this dedicated stand is in standby position (free from rolling function).

Advantageously, this dedicated stand CA is therefore positioned downstream of the last active roll stand which is the one which has its rollers changed most often.

FIGS. 3*a*, 3*b* having already been described, FIG. 3*c* represents the return to standby function of the dedicated stand CA after the return to active rolling position of the stand upstream C=C2 (for which at least one roller has been able to be changed during the phase according to FIG. 3*b*). FIG. 3*c* is therefore a conventional return to FIG. 3*a*.

More precisely according to FIG. 3*b*, during a roller change on the second stand C=C2, its original setpoint value R2 is transferred to a third stand C3 located in the direction D of travel immediately downstream of it, the original setpoint value R3 of said stand C3 downstream being itself transferred to the fourth stand C4 also located immediately downstream of it and so on as far as the dedicated stand CA=C6, itself put into active rolling function during the roller change on the second stand C=C2. Finally, after the roller change on the second stand C=C2 according to FIG. 3*c*, the original setpoint value R2 is restored to the changed second stand C=C2 as for, iteratively, each of the original setpoint values of stands C3, C4, . . . located downstream and so on as far as the dedicated stand CA=C6, then returned to rolling standby function in a free strip clamping position.

The invention claimed is:

1. A method of changing at least one roller in a roll stand adapted for bearing at least one working roller for a continuously running steel-strip roll mill, the method comprising the following steps:

providing the stand as part of a plurality of roll stands disposed in series along the roll mill in a continuous running direction;

allocating a roll standby function in a free clamping position of the at least one roller to at least one dedicated stand among the plurality of stands;

individually allocating original setpoint values controlling an adjustment associated with the clamping of the at least one roller to the other stands in an active rolling position; and in the event of a roller change when passing into the free clamping position, individually redistributing an original setpoint value of the stand and the original setpoint values of stands remaining in an active rolling position among each of the stands, including the dedicated stand.

2. The method according to claim 1, which further comprises, when changing a roller on the stand located upstream of the dedicated stand in the direction of travel in standby position:

transferring the original setpoint value of the stand to a stand located immediately downstream thereof; and transferring the original setpoint value of the latter stand itself to a stand located immediately downstream thereof and, if necessary, so on as far as the dedicated stand in standby position, which is then put into active rolling position.

3. The method according to claim 1, which further comprises, when changing a roller on the stand located downstream of the dedicated stand in the direction of travel in standby position:

transferring the original setpoint value of the stand to a stand located immediately upstream thereof; and transferring the original setpoint value of the latter stand itself to a stand located immediately upstream thereof and, if necessary, so on as far as the dedicated stand in standby position.

4. The method according to claim 1, which further comprises locating the dedicated stand in standby position downstream of the last stand in the direction of travel in active rolling position.

5. The method according to claim 4, which further comprises, when changing a roller on the stand:

transferring its original setpoint value to a stand located immediately downstream thereof in the direction of travel;

transferring the original setpoint value of the stand downstream itself to a stand also located immediately downstream thereof and so on as far as the dedicated stand; and after changing a roller on the stand, restoring the original setpoint value to the changed stand as for, iteratively, each of the original setpoint values of the stands located downstream and so on as far as the dedicated stand being then again returned to roll standby function in a free clamping position.

* * * * *